United States Patent [19]

Kawakami et al.

[11] Patent Number: 4,475,305

[45] Date of Patent: Oct. 9, 1984

[54] TOY VEHICLE WITH INERTIA WHEEL

[75] Inventors: Hirotarou Kawakami, Tokyo; Kazumi Yamakawa, Funabashi; Hiroshi Yasuda, Tokyo; Teruhiko Kitaoka, Nagareyama, all of Japan

[73] Assignee: Asahi Corporation, Tokyo, Japan

[21] Appl. No.: 419,578

[22] Filed: Sep. 17, 1982

[30] Foreign Application Priority Data

Sep. 18, 1981 [JP] Japan ..... 56-138512[U]

[51] Int. Cl.[3] ..... A63H 29/20

[52] U.S. Cl. ..... 446/463; 446/409

[58] Field of Search ..... 46/209, 206, 201, 251, 46/208, 111, 46

[56] References Cited

U.S. PATENT DOCUMENTS

| | | | |
|---|---|---|---|
| 2,624,154 | 1/1953 | Plawner | 46/111 |
| 2,726,482 | 12/1955 | Roehrl et al. | 46/209 X |
| 4,130,963 | 12/1978 | Ohashi . | |
| 4,363,185 | 12/1982 | Masubuchi | 46/209 |
| 4,387,604 | 6/1983 | Maher | 46/209 X |

FOREIGN PATENT DOCUMENTS

| | | |
|---|---|---|
| 1125295 | 8/1969 | United Kingdom . |
| 1495374 | 12/1977 | United Kingdom . |
| 1533374 | 11/1978 | United Kingdom . |

*Primary Examiner*—Mickey Yu

*Attorney, Agent, or Firm*—Fleit, Jacobson, Cohn & Price

[57] ABSTRACT

A toy wheeled vehicle with an inertia wheel having friction driven wheels, an inertia type flywheel, gear trains of a driving mechanism, and a sound generator which is provided coaxially with the flywheel. The driving mechanism includes two groups of gear trains, one is for the flywheel energizing mechanism through a clutch gear and a detachable floating gear and the other is for the rotation transmission mechanism from the energized flywheel to the friction driven wheels through the clutch gear and a stationary gear which is always engaged with the flywheel gear and is detachably engaged with the clutch gear. The energized flywheel which is detached from the floating gear and the wheels through the clutch gear continues to rotate when the wheels are stopped, and when the clutch gear is engaged with the stationary gear, the inertia rotation of the flywheel is transmitted to the wheels, and the sound generator produces the sound of a siren while the flywheel rotates.

8 Claims, 8 Drawing Figures

TOY VEHICLE WITH INERTIA WHEEL

BACKGROUND OF THE INVENTION

The invention relates to an improved and new toy wheeled vehicle with an inertia type flywheel and a sound generator means, and particularly to a driving mechanism of gear trains for the flywheel energizing mechanism and for the flywheel rotation maintaining mechanism when friction driven wheels are stoped and for the rotation transmission mechanism from the energized flywheel to the friction driven wheels through clutch gear means.

A conventional toy vehicle with a flywheel comprises a gear train in a driving mechanism for transmission of the frictional rotation of the friction driven wheels to the flywheel and for transmission of the inertia rotation of the flywheel to the wheels, that is, the same gear train is used to transmit the frictional rotation of the wheels to the flywheel and to transmit conversely the inertia rotation to the wheels. Therefore, the rotatory power of the flywheel loses inevitably, and abrasion of the gear means easily occurs and the toy vehicle is frequently broken down by damage of the gear means.

On the other hand, in the conventional toy vehicle provided a sound generator means which produces sound by rotation of a propella, the sound generator means is provided on a driven means separated from the flywheel. Therefore, the structure thereof is very complicated and it is difficult to assemble the toy, and the toy is easily damaged. Moreover, a bonnet of the conventional toy is fixed to a body, therefore, it is impossible to see an imitated engine and other inner structure within the bonnet, and there is no toy to be able to see the inner imitated mechanical portion from the outer side.

SUMMARY OF THE INVENTION

The present invention of a toy wheeled vehicle with an inertia wheel, which is provided with two gear trains of a driving mechanism and a sound generator means, has features of changeover of the gear trains by a movable clutch gear means and of maintaining the energized rotation of respective transmission of the rotation from friction driving wheels to a flywheel, and conversely from the flywheel to the wheels, and of producing the sound of a siren by the sound generator means. The sound generator means is provided coaxially with the flywheel. The driving mechanism includes two groups of gear trains, one is for the flywheel energizing mechanism, and comprises a wheel gear, a clutch gear means which is movable along the wheel gear, a floating intermediary gear means which is detachably engaged with the clutch gear means, and a flywheel gear means which is detachably engaged with the floating intermediary gear means, and the other gear trains is for the rotation transmission mechanism from the energized flywheel to the friction driven wheels, and comprises the flywheel gear means, a stationary intermediary gear means which is always engaged with the flywheel gear means, the clutch gear means which is detachably engaged with the stationary intermediary gear means, and the wheel gear which is movably and always engaged with the clutch gear means.

Accordingly, a principal object of the present invention is to provide a toy wheeled vehicle with an inertia wheel includes a driving mechanism which comprises two groups of gear trains with a clutch gear means for energizing a flywheel, and respectively for transmitting the inertia rotation of the energized flywheel to friction driven wheels.

Another object of the present invention is to provide a toy wheeled vehicle with an inertial wheel rotates a flywheel and friction driven wheels by two gear trains connects detachably indirectly the flywheel and the wheels to reduce loss of the rotation, to smooth engagement with the gear means, to maintain long time driving the toy vehicle, and to reduce damage of the gear means.

Still another object of the present invention is to provide a toy wheeled vehicle with an inertia wheel includes a sound generator means which is coaxially provided with a flywheel and produces sound of a siren.

A further object of the present invention is to provided a toy wheeled vehicle with an inertia wheel includes an imitated engine apparatus which is preferable set in a transparent housing.

Other objects and many of the attendant advantages of this invention will be readily appreciated as the same become better understood by reference to the following description on basis of the attached drawings.

BRIEF DESCRIPTION OF THE DRAWING

The accompanying drawings illustrate the preferred embodiments of the present invention. In the drawings, the same reference numerals illustrate the same parts of the invention, in which.

THE DETAILED DESCRIPTION OF THE INVENTION

Figure 1:
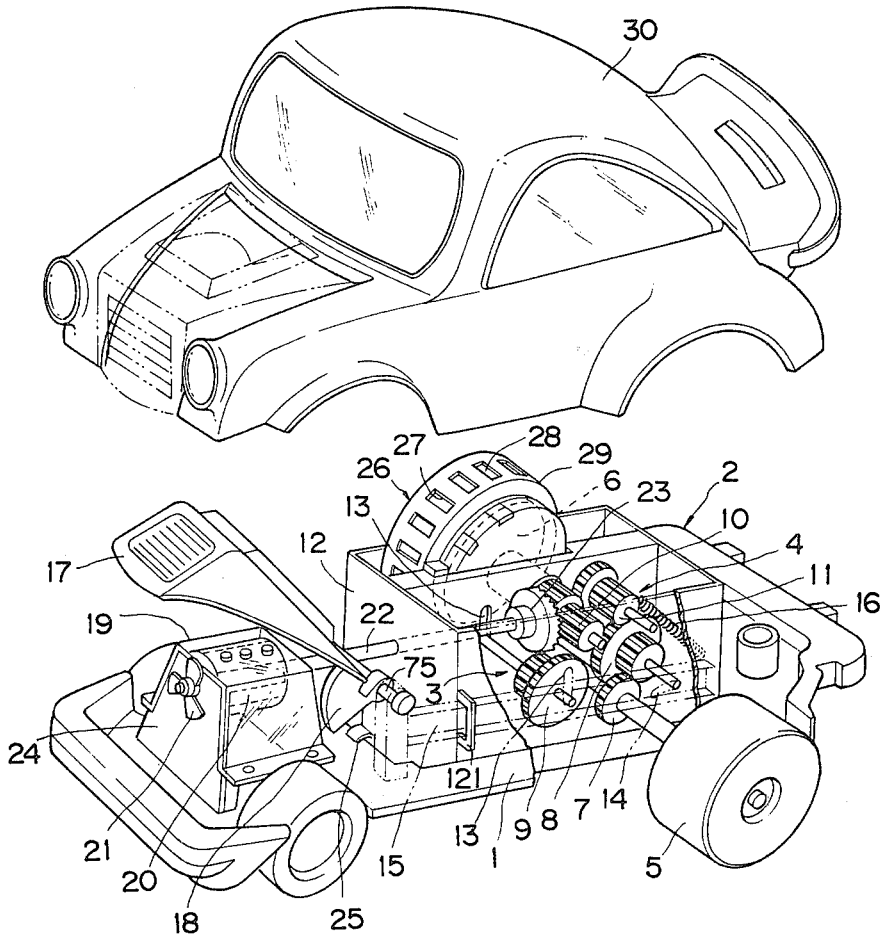
FIG. 1 is an exploded perspective view, partially in section of the first embodiment of the present invention.
Figure 2:
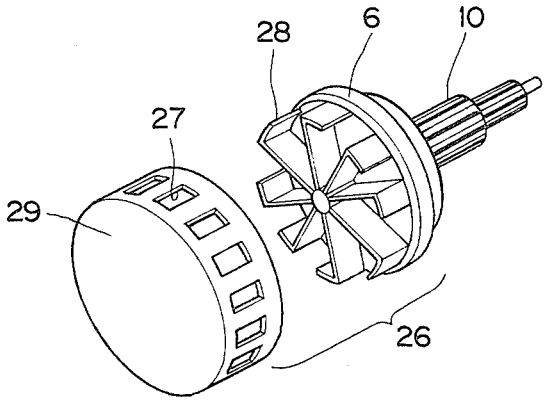
FIG. 2 is an exploded perspective view of a siren apparatus which is coaxially mounted on a flywheel axle.
Figure 3:
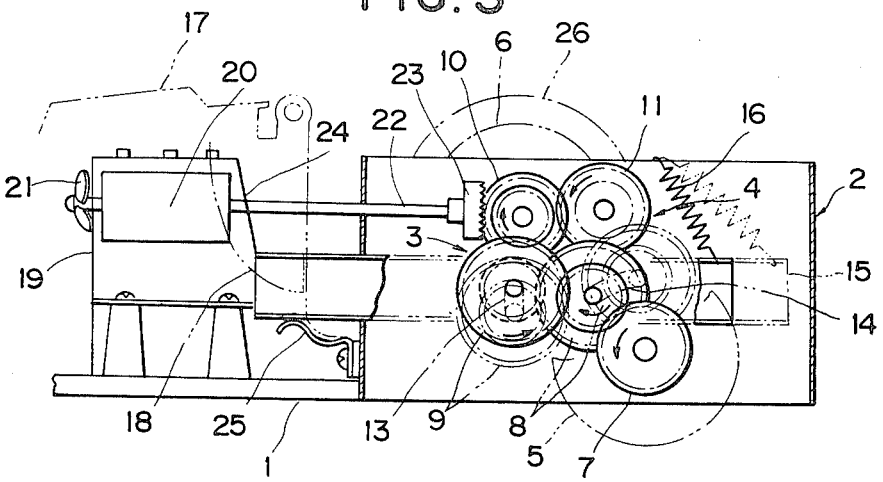
FIG. 3 is a cross sectional side view of gear trains of a driving mechanism.

Attention is turned to the detailed description of the present invention as illustrated in the accompanying drawings wherein there is shown the preferred embodiments of the invention. With regard to one embodiment of the present invention shown in FIG. 1, which shows a toy wheeled vehicle of the present invention, the toy wheeled vehicle comprises a chassis 1 and a driving mechanism 2. The driving mechanism 2 comprises two groups of the gear trains, one is a main driving structure 3 for transmitting the rotation to an inertia type flywheel 6 from a friction driven wheels 5 and for energizing the flywheel 6, and the other is a secondary driving structure 4 for transmitting the inertia rotation to the wheels 5 from the flywheel 6, that is, the main driving structure 3 includes a gear train which is driven to transmit the frictional rotation of the wheels 5 to the flywheel 6, which are energized and rotated by pushing the vehicle along a friction surface, such as a table or floor quickly a number of times to get the flywheel rotation at high speed, and the secondary driving structure 4 includes a gear train which is driven independently from the other gear train to transmit conversely the inertia rotation of the flywheel 6 to the wheels 5.

The main driving structure 3 comprises a wheel gear 7, a clutch gear means 8, a floating intermediary gear means 9, and a flywheel gear means 10. The secondary driving structure 4 comprises the flywheel gear means 10 which is used commonly with the main driving structure 3, a stationary intermediary gear means 11, the clutch gear means 8 and the wheel gear 7 which are respectively commonly used with the main driving structure 3.

Now, the structure of the driving mechanism is disclosed in detailed. Firstly, the main driving structure is explained. The wheel gear 7 is mounted on an axle 71, and the friction driven wheels 5 are fixed at both ends of the axle 71. The axle 71 is received in bearing holes 72 which are provided in parallel side walls of a casing 12 mounted on the chassis 1.

The clutch gear means 8 includes a pinion 81 and a gear 82, and is mounted on an axle 83, both ends of the axle 83 are rotatably inserted and received in inclined in an arc slots 14 which are provided in parallel in the side walls of the casing 12. The pinion 81 is engaged with the wheel gear 7 to move in an arc along the gear 7.

The floating intermediary gear means 9 includes a pinion 91 and a gear 92, and is mounted on an axle 93, both ends of the axle 93 are movably inserted and received in vertical slots 13 which are provided in parallel in the side walls of the casing 12. The pinion 91 is detachably engaged with the gear 82 of the clutch gear means 8. The floating intermediary gear means 9 floats in the vertical slots 13 when the clutch gear means 8 is operably engaged and rotated with the gear means 9.

The flywheel gear means 10 includes two pinions 101, 102, and is mounted on an axle 103, both ends of the axle 103 are rotatably received in bearing holes 104 which are provided in parallel in the side walls of the casing 12. The pinion 101 is detachably engaged with the gear 92 of the floating intermediary gear means 9 in a condition that the gear means 9 is floated in the vertical slots 13 when the friction driven wheels 5 are rotated to energize the flywheel 6.

Secondly, the secondary driving structure 4 is explained. As above stated, the flywheel gear means 10, the clutch gear means 8, and the wheel gear 7 are commonly used to the secondary driving structure 4, too.

The stationary intermediary gear means 11 includes a pinion 111 and a gear 112, and is mounted on an axle 113, both ends of the axle 113 are rotatably received in bearing holes 114 which are provided in parallel in the side walls of the casing 12. The gear 112 is engaged with the pinion 102, and the pinion 111 is detachably engaged with the gear 82 of the clutch gear means 8 when the inertia rotation of the flywheel 6 is transmitted to the wheels 5.

The clutch gear means 8 exercises changeover between the gear trains of the main driving structure and the secondary driving structure, and smoothes transmission of the rotation between the friction driving wheels 5 and the inertia flywheel 6. The floating intermediary gear means 9 floats vertically in the slots 13 in accordance with engagement with the clutch gear means 8 which moves downwardly in the inclined slots 14 and is rotating with the wheels 5. And the floated gear means 9 engages with the flywheel gear means 10.

A clutch gear driving means 15 is provided slidably with the side wall of the casing 12, and in this embodiment, a slide bar member is adopted as the clutch gear driving means 15. The clutch gear driving means 15 is forced by a spring means 16 to slide in accordance with the first rotating force of the clutch gear means 8 into a condition that the clutch gear means is engaged with the floating intermediary gear means 9. And the clutch gear driving means 15 is resiliently fastened by a spring member 25 which is provided at an end of the clutch gear driving means 15 on the chassis 1, in a condition that the clutch gear means 8 is engaged with the stationary intermediary gear means 11.

An operating member 18 for operating the clutch gear driving means 15 is pivotally provided with a pivotal end portion of a bonnet 17 which is pivotally attached on an axle 75, adjacent to the end of the clutch gear driving means 15 for pushing said end. When the clutch gear means 8 is engaged with the floating intermediary gear means, the end of the clutch gear driving means 15 pushes the operating member 18 which is pivotally moved on the axle 75 with the bonnet 17. The bonnet 17 is pivotally moved and opens, and conversely, when the bonnet 17 is closed by pushing thereof, the operating member 15 pushes and slides the clutch gear driving means 15, and the clutch gear means is detached from the floating intermediary gear means 9 and is engaged with the stationary intermediary gear means 11. Therefore the energized inertia rotation of the flywheel 6 is transmitted to the wheels 5 through the gear train of the secondary driving structure 4.

Figure 7:
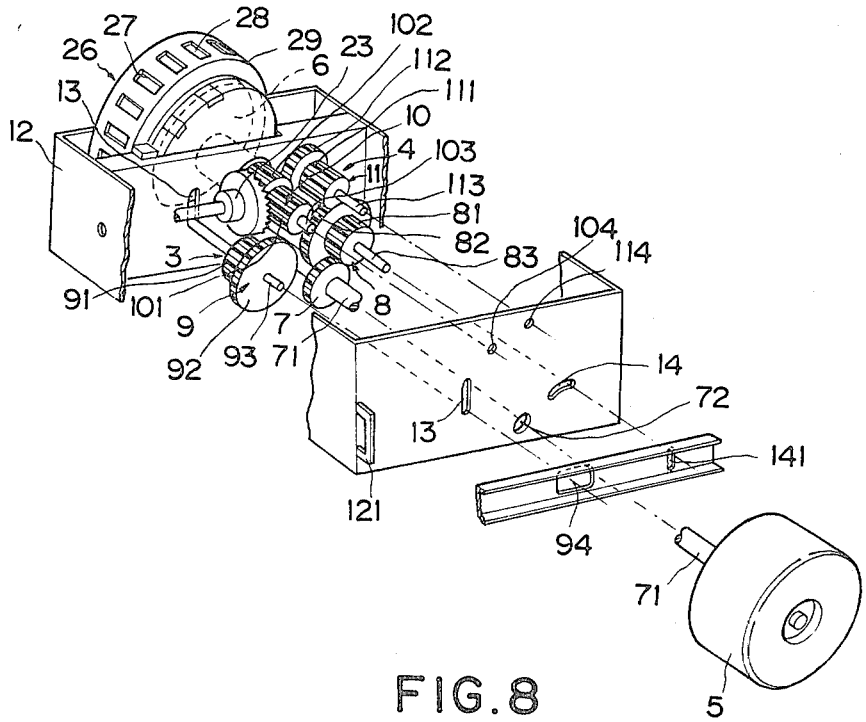
FIG. 7 is an exploded perspective view of the driving mechanism similar to FIG. 1, showing specifically slots and openings in a casing and a clutch gear operating member.

In this embodiment, a supporting member 121 is extended from the side wall of the casing 12, through which the slide bar member 15 is slidably supported. The slide bar member 15 is respectively provided a vertical slot 141 and an opening 94 as shown in FIG. 7. The end of the axle 83 of the clutch gear means 8 is movably inserted in said vertical slot 141 through the inclined slot 14 of the side wall of the casing 12, and the end of the axle 93 of the floating intermediary gear means 9 is faced in said opening 94 through the vertical slot 13 of the side wall of the casing 12. When the axle 83 of the clutch gear means 8 is slidably moved in an arc in the inclined slot 14, the end of the axle 83 operates and moves horizontally the slide bar member 15, and simulataneously the end of the axle 83 moves vertically in the vertical slot 141 of the slide bar member 15. In this time, the end of the axle 93 of the floating intermediary gear means 9 is not prevented in the opening 94 to move vertically along the vertical slot 13 of the side wall of the casing 12.

Figure 4:
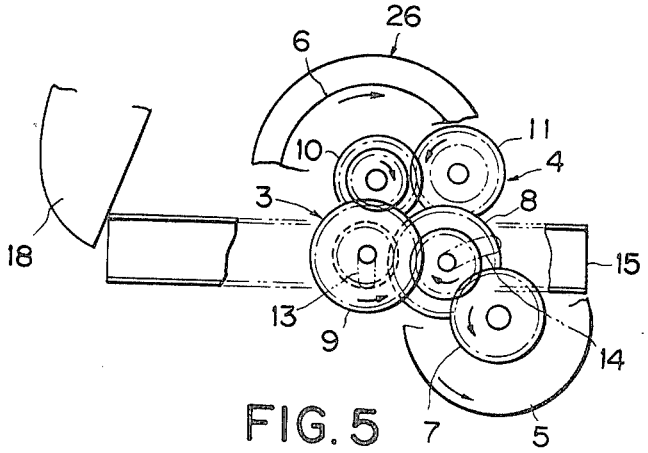
FIGS. 4, 5 and 6 are explanatory side views of the gear trains of the driving mechanism, showing the respective engagement of the two groups of the gear trains for energizing a flywheel and for transmitting the rotation of the flywheel to wheels.

With regard to FIGS. 3, 4, 5 and 6, as shown in FIG. 4 when the friction driven wheels 5 are energized and rotated along the surface, such as a table or floor, the wheels 5 and its wheel gear 7 rotate as shown by arrow heads. And the clutch gear means 8 which is engaged with the wheel gear 7 is rotated as shown by an arrow head and is moved downwardly by the force of the rotation of the wheel gear 7 in the inclined slot 14. The clutch gear means 8, which is moved downwardly, is engaged with the floating intermediary gear means 9. The floating intermediary gear means 9, which is engaged with the clutch gear 8, is rotated as shown by an arrow head and is floated by the force of the rotation of the clutch gear means 8, and is simultaneously engaged with the flywheel gear means 10. By the respective engagement of the gear means 7, 8, 9 and 10, the gear train of the main driving structure is accomplished. In this condition, the flywheel gear means 10 is engaged with the stationary intermediary gear means 11 which is rotated by the flywheel gear means 10, but the stationary intermediary gear means 11 is not engaged with the clutch gear means 8. By this rotation of the flywheel gear means 10, the inertia flywheel 6 is energized and is continually rotating.

Figure 5:
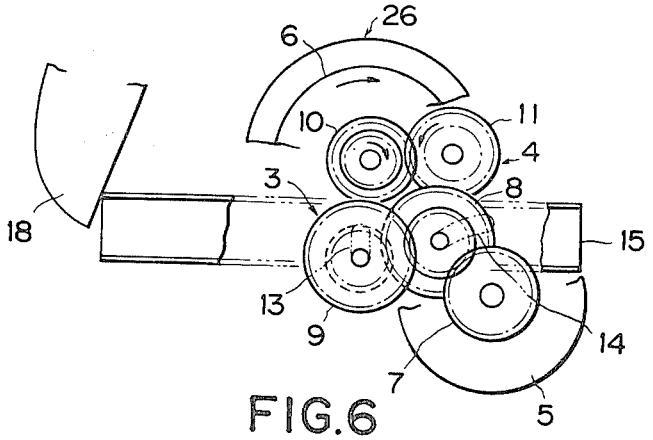

By the way, as shown in FIG. 5, when the friction driving wheels 5 stopped energizing and rotating thereof, the clutch gear means 8 stops. Therefore the force of the rotation is not added to the floating intermediary gear means 9, and the floating intermediary gear means 9 falls within the vertical slot 13 by its gravity, and detaches from the flywheel gear means 10. Accordingly, the flywheel 6, with the flywheel gear means 10, and the stationary intermediary gear means 11 rotate independently from other stopped gear means 7, 8 and 9.

Figure 6:
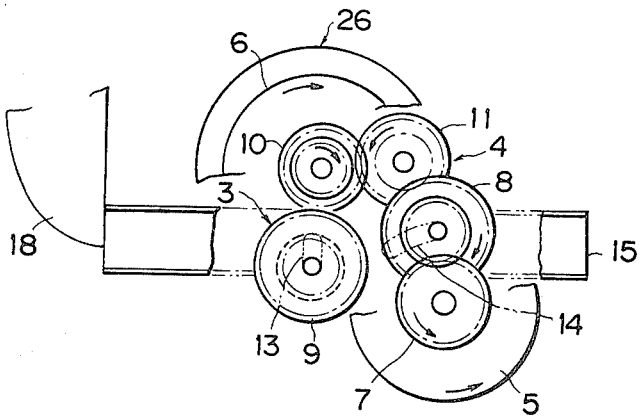

When the bonnet 17 is closed by pushing thereof, the operating memger 18 pushes and slides the slide bar member 15, and the end of the axle 83 of the clutch gear means 8 is moved upwardly within the slot 141 and within the slots 14. Accordingly, as shown in FIG. 6, the clutch gear means is detached from the floating intermediary gear means, and is engaged with the rotating stationary intermediary gear means 11. Therefore, the energized inertia rotation of the flywheel is transmitted to the wheels through the gear means 10, 11, 8 and 7 as shown by arrow heads, and the toy vehicle starts forward.

An imitated engine members 19 is provided on the toy vehicle, and is able to be set in a transparent casing 24. The imitated engine member 19 comprises an imitated engine rotor 20 and a propella 21, and are connected with a shaft 22. The shaft 22 has a crown gear 23 at an end thereof, and the crown gear 23 is engaged with the pinion of the flywheel gear means 10. In accordance with the rotation of the flywheel gear means 10, the crown gear 23 is rotated, and the rotation is transmitted to the shaft 22 and the imitated engine member 19, and the propella 21 is consequently rotated and the imitated engine rotor 20 is swung by means of an eccentric base of the propella 21 and a groove, which is provided in the member 19, which are not shown in the drawings. The shaft 22 extends through a hole provided in a front wall of the casing 12.

Figure 8:
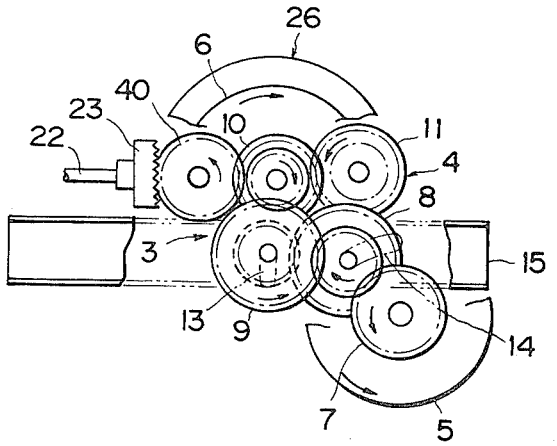
FIG. 8 is an explanatory side view of gear trains of a second embodiment of an assembled driving mechanism.

The crown gear 23 can be engaged with one of the gears of the secondary driving structure 4 instead of the flywheel gear means. And, as shown in FIG. 8, an additional gear 40 can be provided with between the flywheel gear means 10 and the crown gear 23 so as to engage respectively therewith. And the shaft 22 can be connected to the imitated engine member 19 through another shaft and other gear means which can be provided at ends of both shafts which are not shown in the drawings.

A sound generator means 26 is provided coaxially on the axle of the flywheel to produce a siren-like sound. The sound generator means 26 can be mounted on the flywheel 6, or can be provided independently from the flywheel 6. The sound generator means 26 comprises a rotor 28 and a cover 29 which is formed vents 27 through a circumferential wall thereof. A side wall of the flywheel 6 is commonly used as a side wall of the sound generator means 26. The rotor 28 is fixed coaxially with the flywheel 6, and the cover 29 is covered over the rotor 28 and is fitted the circumferential outer surface of the flywheel 6.

When the flywheel 6 is rotated in accordance with the energizing rotation of the friction driven wheels 5, the sound generator means 26 produces the a siren-like sound, and the imitated engine rotor 20 and the propella 21 of the imitated engine member 19 moves operably. The producing the siren-like sound of the sound generator means 26 and the operable moving the imitated engine means are respectively maintained as far as the flywheel 6 rotates.

After the elements of the driving mechanism, the imitated engine member, and the sound generator means are assembled, a cover element 30 of the body is covered on the chassis 1. As stated above, the present invention of the toy wheeled vehicle with the inertia type flywheel has two groups of gear trains with the clutch gear means for energizing the flywheel, and for transmitting the energized inertia rotation of the flywheel to the friction driven wheels, the reduction of loss of the rotatory power, the smooth engagement of the gear means, and the maintenance of the long time driving the vehicle are respectively realized. And, it is possible to take pleasure at the same time in the mechanical operation of the siren-like sound and of the movement of the imitated engine means in addition to both essential conditions of the stopping the wheels during the inertia rotation of the flywheel, and of the driving the toy vehicle.

Many prominent and excellent features of the present invention shall become manifest from the above description. The size of the elements is not limited and the size and shape thereof shall be changed and also considered in accordance with suitable requirements of the subject. Any change and other embodiments on design with regard to the electromagnetic valve apparatus shall be included in the scope of the Claims of the present invention.

What is claimed is:

1. A toy wheeled vehicle with an inertia wheel having a body, friction driven wheels supported on ends of a wheel axle, an inertia-type flywheel mounted on an axle, and a driving mechanism being rotatably set in a casing, said vehicle comprising:

a. a main driving mechanism operable to transmit the rotation of the friction driven wheels to the inertia-type flywheel, said main driving mechanism having gear trains including:
   - a wheel gear mounted on the wheel axle,
   - a clutch gear means mounted on an axle, engaging with the wheel gear movably thereon,
   - a floating intermediary gear means mounted on an axle, engaging detachably with the clutch gear means, and
   - a flywheel gear means mounted on the flywheel axle, engaging detachably with the floating intermediary gear means;

b. a secondary driving mechanism operable to transmit the rotation of the flywheel to the friction driven wheels, said secondary driving mechanism having gear trains including:
   - a stationary intermediary gear means mounted on an axle, engaging with the flywheel gear means,
   - said flywheel gear means detached from the floating intermediary gear means,
   - said clutch gear means detached from the floating intermediary gear means, and said wheel gear engaging detachably through the clutch gear means and the stationary intermediary gear means with the flywheel gear means;

c. a clutch gear driving means mounted on an end of the clutch gear axle to actuate the clutch gear means between the wheel gear, the floating intermediary gear means and the stationary intermediary gear means;

d. an operating member operable to move the clutch gear driving means; and e. wherein the clutch gear means has a gear and a pinion which is engaged with the wheel gear, the floating intermediary gear means has a gear and a pinion which is detachably engaged with the gear of the clutch gear means, the flywheel gear means has two pinions and one of said pinions is detachably engaged with the gear of the floating intermediary gear means, the stationary intermediary gear means has respectively a gear which is engaged with the other remaining pinion of the flywheel gear means, and a pinion which is detachably engaged with the gear of the clutch gear means, the clutch gear driving means is slidably supported on at least one side wall of the casing of the driving mechanism, the operating member is provided at an end portion of the clutch gear driving means to move said driving means for engagement of the clutch gear means between the stationary intermediary gear means and the wheel gear, and wherein side walls of the casing are parallel and include an inclined slot and a vertical slot, and the ends of the clutch gear axle are inserted in the inclined slots to move in an arc therein along the wheel gear, and the ends of the axle of the floating intermediary gear means are floatably inserted in the vertical slots to move in the vertical direction therein, and ends of the remaining axles are rotatably mounted in respective bearing holes which are provided in the side walls of the casing.

2. The toy vehicle of claim 1 wherein the clutch gear driving means is a slide bar member which includes a vertical slot and an opening, and the end of the axle of the clutch gear means is movably inserted in said vertical slot through the inclined slot of the side wall of the casing, and the end of the axle of the floating intermediary gear means extends through said opening through the vertical slot of the side wall of the casing, and said clutch gear driving means is resiliently fastened by a spring member in a condition that the clutch gear means is engaged with the stationary intermediary gear means, and is simultaneously forced by a spring means to slide with the clutch gear means into a condition that the clutch gear means is engaged with the floating intermediary gear means, further, the operating member for the slide bar member is pivotally provided with a pivotal end portion of a bonnet of the vehicle and adjacent to the end of the slide bar member to push said end when the clutch gear means is engaged with the floating intermediary gear means, said bonnet being pivotally opened by the operating member which is pivotally moved in accordance with the movement of the slide bar member and the clutch gear means, and when the bonnet is closed the operating member slides the slide bar member, and the clutch gear means is detached from the floating intermediary gear means and is engaged with the stationary intermediary gear means, and the rotation from the flywheel is transmitted to the wheels through the gear means.

3. The toy vehicle of claim 2 wherein the inclined slot of the side wall of the casing is formed in an arc-shape to move the clutch gear means along the wheel gear in the engaging condition therewith.

4. A toy wheeled vehicle having a body including an openable bonnet, friction driven wheels supported on ends of a wheel axle, an inertia-type flywheel mounted on an axle, and driving mechanisms rotatably carried in a casing, said vehicle comprising:

a. a casing for supporting driving mechanisms, said casing including walls having a vertical slot and an arcuate slot;

b. a main driving mechanism for transmitting the rotation of the friction driven wheels to the inertia-type flywheel and, having gear trains, said main driving mechanism including:

a wheel gear mounted on a wheel axle rotatably carried in said casing;

a clutch gear means engaging with the wheel gear and mounted on an axle rotatably carried in said casing and movable relative thereto;

a floating intermediary gear means mounted on an axle rotatably carried in said casing and movable relative thereto, said intermediary gear engaging detachably with the clutch gear means; and a flywheel gear means mounted on a flywheel axle rotatably carried in said casing and, engaging detachably with the floating intermediary gear means;

c. a secondary driving mechanism for transmitting the rotation of the flywheel to the driven wheels, said secondary driving mechanism having gear trains including:

a fixed intermediary gear means mounted on an axle rotatably carried in said casing, said fixed intermediary gear means engaging with the flywheel gear means, said floating intermediary gear means disengaged from said flywheel gear means and said clutch gear means during transmission of rotation from said flywheel to said wheels, and said wheel gear engaging detachably through the clutch gear means and the stationary intermediary gear means with the flywheel gear means;

d. clutch gear driving means including a movable slide bar member having a vertical slot to rotatably receive the axle of the clutch gear means and an opening to permit the axle of said floating intermediary gear means to pass freely therethrough over the range of movement of said slide bar, and resilient engagement means to frictionally engage said clutch gear driving means; and e. an operating member having an end portion secured to the pivotally movable bonnet of the toy vehicle and positioned adjacent to an end of the clutch gear driving means to contact said end to permit movement of said clutch gear driving means to disengage said clutch gear means from said floating intermediary gear means.

5. The toy wheeled vehicle of claim 4 wherein an end of the axle of the clutch gear means is movably inserted in the vertical slot of the clutch gear driving means through the arcuate slot of the casing, and an end of the axle of the floating intermediary gear means passes freely through the opening of the clutch gear driving means and through the vertical slot of the casing.

6. The toy wheeled vehicle of claim 4 wherein when the clutch gear means is engaged with the floating intermediary gear means, said bonnet is pivotally opened by the operating member by movement of the slide bar member and the clutch gear means, and when the bonnet is moved from the open position to the closed position the operating member slides the slide bar member and the clutch gear means is disengaged from the floating intermediary gear means and is engaged with the stationary intermediary gear means, and rotation of the flywheel is transmitted to the wheels through said secondary driving mechanism.

7. The toy wheeled vehicle of claim 4 wherein when the flywheel is rotated by rapid frictional rotation of the driving wheels, the clutch gear driving means is moved against the friction of said resilient engagement means by the axle of said clutch gear means.

8. The toy wheeled vehicle of claim 4, further comprising an engine member and a shaft which is operably connected to the engine member at one end thereof to swing said member, and is connected with the driving mechanism through an opening provided in said casing, and by a crown gear which is secured to an end of the shaft and is operatively engaged with the driving mechanism.

* * * * *